US006497531B2

(12) United States Patent
Sipherd et al.

(10) Patent No.: US 6,497,531 B2
(45) Date of Patent: Dec. 24, 2002

(54) CONCRETE CURING MACHINE

(75) Inventors: Chapin Baum Sipherd, Oklahoma City, OK (US); John Robert Lease, Canton, SD (US); Robert L. Stainbrook, Sioux Falls, SD (US)

(73) Assignee: CMI Terex Corporation, Oklahoma City, OK (US)

( * ) Notice: Subject to any disclaimer, the term of this patent is extended or adjusted under 35 U.S.C. 154(b) by 0 days.

(21) Appl. No.: 09/792,270

(22) Filed: Feb. 24, 2001

(65) Prior Publication Data

US 2002/0119004 A1 Aug. 29, 2002

(51) Int. Cl.[7] ..... E01C 19/18; B67D 3/00

(52) U.S. Cl. ..... 404/111; 404/101; 404/108; 222/526

(58) Field of Search ..... 404/101, 111, 404/93, 94, 108; 222/526

(56) References Cited

U.S. PATENT DOCUMENTS

| | | | | | |
|---|---|---|---|---|---|
| 3,850,541 | A | | 11/1974 | Baillet et al. | 404/114 |
| 3,874,806 | A | * | 4/1975 | Grist et al. | 404/93 |
| 4,070,128 | A | | 1/1978 | Garrison | 404/89 |
| 4,297,399 | A | | 10/1981 | Perz | 427/385.5 |
| 4,318,631 | A | | 3/1982 | Vickers | 404/93 |
| 4,411,554 | A | * | 10/1983 | Gratzfeld | 404/110 |
| 4,449,667 | A | * | 5/1984 | Tyler | 239/167 |
| 4,541,750 | A | * | 9/1985 | Owens | 118/305 |
| 4,555,200 | A | * | 11/1985 | Morrison | 165/185 |
| 4,571,120 | A | * | 2/1986 | Schoenhard | 118/100 |
| 4,572,704 | A | * | 2/1986 | Allen | 404/101 |
| 4,607,979 | A | * | 8/1986 | Morrison | 222/330 |
| 4,657,431 | A | * | 4/1987 | Morrison | 222/238 |
| 4,822,210 | A | * | 4/1989 | Oury et al. | 404/106 |
| 4,960,242 | A | * | 10/1990 | Larson | 239/168 |
| 4,968,099 | A | | 11/1990 | Meister | 299/1 |
| 4,986,473 | A | * | 1/1991 | Semple et al. | 239/109 |
| 5,187,882 | A | | 2/1993 | Leach | 34/46 |
| 5,249,886 | A | | 10/1993 | Huerta, Jr. | 404/89 |
| 5,324,136 | A | * | 6/1994 | Reymonet et al. | 404/107 |
| 5,348,226 | A | * | 9/1994 | Heiniger et al. | 239/1 |
| 5,590,977 | A | * | 1/1997 | Guntert et al. | 404/101 |
| 5,707,179 | A | | 1/1998 | Bruckelmyer | 405/229 |
| 5,855,978 | A | | 1/1999 | Handwerker | 428/57 |
| 5,957,621 | A | * | 9/1999 | Clark et al. | 239/159 |

FOREIGN PATENT DOCUMENTS

| | | | |
|---|---|---|---|
| DE | 40 16 545 | * | 11/1991 |
| WO | 91/01432 | * | 2/1991 |

* cited by examiner

*Primary Examiner*—Gary S. Hartmann
(74) *Attorney, Agent, or Firm*—Emrich & Dithmar

(57) ABSTRACT

A concrete curing and texturing machine includes a truss frame supporting a reservoir of curing fluid and drive members positioned at the ends of the truss frame for powering the machine longitudinally along a roadway being surfaced. A texturing carriage is mounted to the truss frame and arranged to longitudinally move back and forth along the truss frame. A truss member is mounted rearwardly of the truss frame and includes a sprayboom carriage unit which moves longitudinally move back and forth along the truss member. The sprayboom carriage unit supports a sprayboom having a plurality of nozzles operatively connected to the liquid reservoir.

21 Claims, 7 Drawing Sheets

CONCRETE CURING MACHINE

BACKGROUND OF THE INVENTION

The present invention relates to a concrete curing and texturing machine, and more particularly, to a novel curing and texturing machine which permits longitudinal and transverse texturing or grooving of the finished concrete and the transverse application of a predetermined amount of curing liquid onto the textured or grooved concrete surface.

The curing treatment of finished concrete during the concrete's hardening period is designed to prevent water loss from the concrete and optimize the cement hydration. The curing treatment maintains predetermined moisture levels and temperature conditions in the finished concrete, levels and conditions which influence the desired concrete properties of the finished concrete.

Concrete curing and texturing machines for use on a concrete surface are known in the art. Generally, such machines include an elongated main frame adapted for movement longitudinally along the roadway or deck which is to be grooved and cured. A grooving unit may be suspended from the elongated main frame for longitudinal movement back and forth across the roadway. After each pass of the grooving unit or rake-type implement, the grooving head automatically raises at either end of each pass and is cleaned and then the machine is automatically moved forward a distance corresponding to the length of the grooving unit to permit a subsequent pass across the body of concrete with the grooving unit. After several passes of the grooving unit, in one type of curing and texturing machine, the machine is backed up to the initial starting point and the curing compound is sprayed onto the grooved concrete. In another type of curing and texturing machine, a plurality of nozzles extend across the width of the body of concrete and are suspended from the elongated main frame. As the machine is moved forwardly during the grooving operation, a curing compound is sprayed upon the surface of the textured or grooved concrete. In yet another type of prior art grooving and texturing machine, the nozzles are positioned on the grooving unit and the curing compound is sprayed onto the concrete surface during the grooving operation.

In a further prior art alternative system, workers manually rake the surface of the concrete to texture or groove the concrete surface and then a curing machine is then passed over the surface of the grooved concrete to deposit the curing compound onto the surface of the grooved concrete. Such machines utilize a plurality of nozzles extending across the width of the machine.

The stop and go action and the lack of continuous operation with the prior art grooving of the finished concrete and the delay in the application of a curing compound onto the surface of the grooved concrete is time consuming, labor intensive, and fails to optimize the cement hydration. Moreover, the positioning of a plurality of nozzles extending across the body of the grooved concrete results in an uneven application of curing compound on the surface of the grooved concrete. Finally, the application of the curing compound directly onto the concrete during the grooving operation results in a non-uniform curing compound application. This results in uneven curing of the finished concrete and provides a cured concrete having an unacceptable cement of hydration.

SUMMARY OF THE INVENTION

It is one object of the present invention to provide a novel concrete curing machine which provides for the application of curing compound onto a concrete surface or roadway in a transverse back and forth manner.

It is an object of the present invention to provide a concrete curing and texturing machine which overcomes the problems encountered by the prior art curing and texturing machines.

It is another object of the present invention to provide a curing machine which provides for the transverse application of curing compound upon the grooved concrete roadway.

It is yet another object of the present invention to provide a novel curing machine which provides for the predetermined spraying of controlled amounts of curing compound onto the concrete surface with the spray application being applied through spray nozzles moving transversely back and forth across the body of the poured concrete.

Finally, it is another object of the present invention to provide a curing and texturing machine which includes the longitudinal or transverse texturing or grooving of the concrete and which includes a curing application portion wherein the curing compound is applied by a sprayboom carriage which is movable transversely back and forth across the surface of the textured concrete.

These and other objects of the present invention are achieved by the present invention which includes a concrete curing and texturing machine of the type embodying an elongated main frame adapted for movement longitudinally along a roadway or deck surface of poured concrete. The concrete curing and texturing machine is mounted for movement on twotracks, four-tracks or rubber tires mounted to the corners of the elongated main frame. Preferably, mounted to the main frame is a texturing or rake-type implement carriage which is structurally arranged to engage the concrete surface to provide grooves therein during the transverse back and forth movement of the texturing carriage across the body of the concrete. Mounted to and extending rearwardly of the main frame is an extended truss member on which is mounted a sprayboom carriage member. The sprayboom carriage is mounted on the extended truss frame and is adapted for transverse movement back and forth across the width of the body of poured concrete. The sprayboom carriage extends rearwardly of the curing and texturing main frame and supports and positions a boom pipe and the associated spray nozzle assembly a predetermined distance above the concrete surface, with the sprayboom carriage structurally arranged to move back and forth transversely across the concrete surface.

The curing compound is directed through the boom pipe and spray nozzles to deposit a uniform and predetermined amount of curing compound onto the concrete surface. The sprayboom carriage is structurally arranged to be driven by a hydraulic motor coupled to a drive sprocket and drive chain attached to the sprayboom carriage to provide the transverse movement of the carriage, boom pipe and spray nozzles back and forth across the surface of the grooved and textured concrete.

The present invention consists of certain novel features and structural details hereinafter fully described, illustrated in the accompanying drawings, and particularly pointed out in the appended claims, it being understood that various changes in the details may be made without departing from the spirit or sacrifice any of the advantages of the present invention.

DESCRIPTION OF THE DRAWINGS

For the purpose of facilitating and understanding the present invention, there is illustrated in the accompanying drawings a preferred embodiment thereof, from an inspection of which, when considered in connection with the following description, the invention, its construction and operation and many of its advantages may be readily understood and appreciated.

DESCRIPTION OF THE EMBODIMENT

Figure 1:
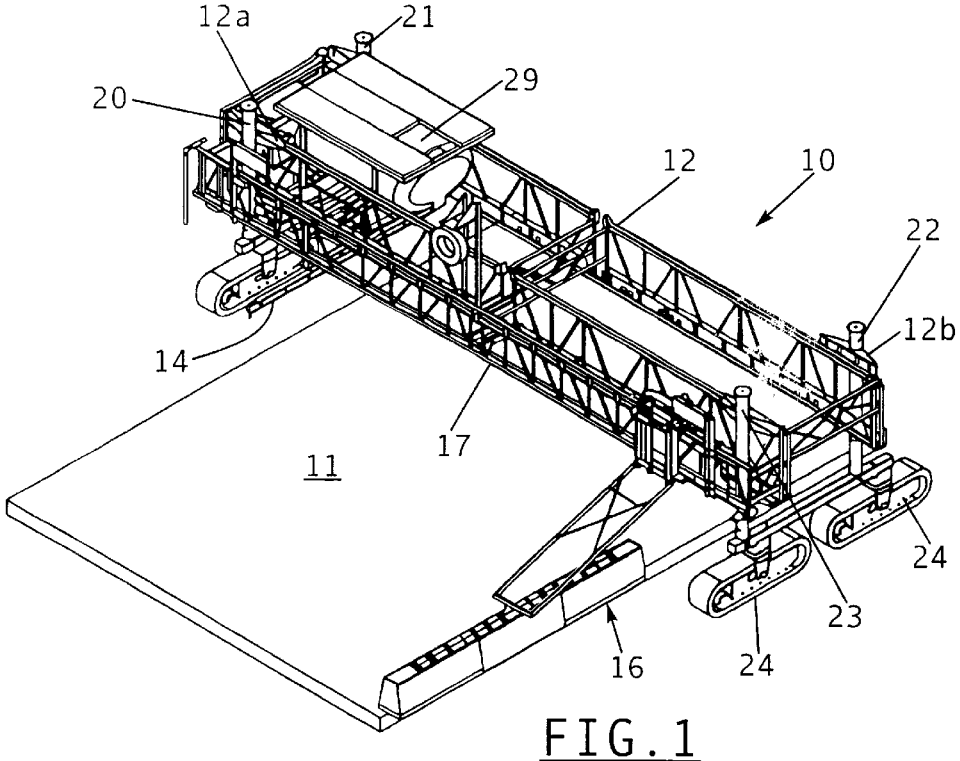
FIG. 1 is a rear perspective view of the concrete curing and texturing machine in accordance with one embodiment of the present invention.
Figure 2:
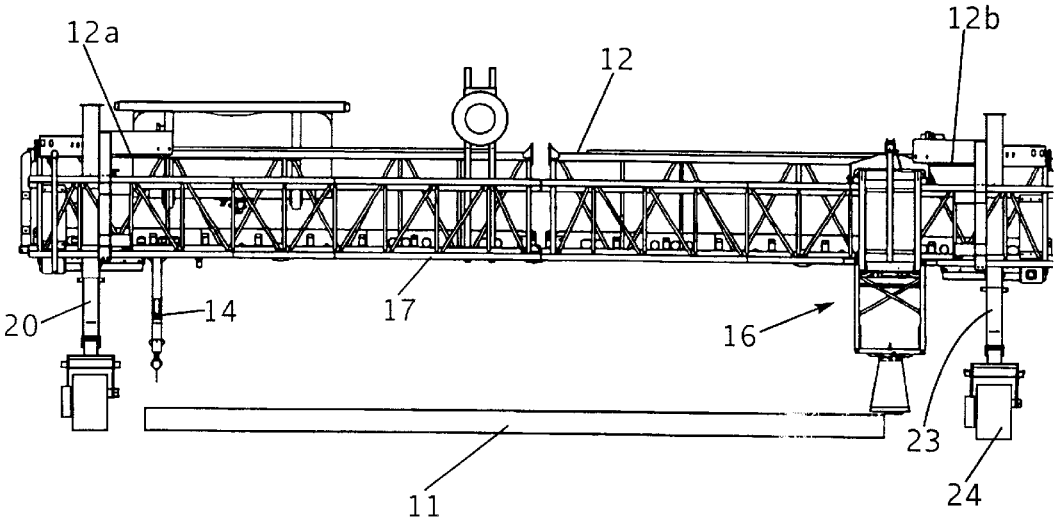
FIG. 2 is a rear view of the concrete curing and texturing machine in accordance with the embodiment of the present invention shown in FIG. 1.

Referring now to the drawings wherein like numerals have been used throughout the several views to designate the same or similar parts, a concrete curing and texturing machine 10 embodying the principles of the present invention is shown. The curing and texturing machine 10 is shown in FIG. 1 as being disposed in operative position over a section of a concrete roadway, street, runway or bridge deck 11. The concrete curing and texturing machine 10 shown in FIG. 1 is drawn by way of illustration and not by way of limitation and may be used on other suitable types of concrete curing and texturing machines wherein the curing machine includes a main trusswork or frame member 12 having ends 12*a* and 12*b*, with the main trusswork member extending across and over the surface of the concrete roadway 11.

The concrete curing and texturing machine 10 includes an elongated trusswork or frame 12 on which may be mounted a texturing or grooving unit 14 (FIGS. 2, 11 and 12) that is movable back and forth between the ends 12*a* and 12*b* of the frame 12. A sprayboom carriage unit 16 may be mounted to the elongated trusswork or frame 12; however, preferably, the sprayboom carriage unit 16 is mounted to an extension frame member 17 which is mounted to and positioned rearwardly of the elongated trusswork frame 12. Positioned at the ends 12*a* and 12*b* of the elongated trusswork or frame member 12 are leg-type supporting units 20, 21, 22, and 23 of a type known in the art. As shown in FIGS. 1–4 and 11, power driven four-track drive units 24 are mounted to the lower end portions of the leg type supporting units 20, 21, 22 and 23 to support and power the concrete curing and texturing machine 10. The leg-type supporting units 20–23 are vertically adjustable relative to the four-track units 24 by suitable means for adjusting the proper height of the concrete curing and texturing machine relative to the surface of the finished concrete. Also, it is within the scope of the present invention that various types of rubber wheel units 26 (FIG. 3A) or two-track units 28 (FIG. 3B) may be secured to the lower end portions of the leg-type supporting units 20–23 to support and power the curing and texturing machine 10. When the drive member is a two-track drive member; the curing machine is not driven in a direction parallel to the elongated trusswork or frame 12. However, when the drive unit is either a four-track drive unit or a rubber wheel drive unit, the drive unit may be turned 90° to power the curing machine in a direction parallel with the elongated trusswork.

In FIGS. 3,4 and 8–10, a sprayboom carriage unit 16 is shown which is mounted to the extension truss member 17 located rearwardly of the concrete curing machine 10. The sprayboom carriage unit is comprised of a carriage panel 34 which includes side thrust rollers 35 and carriage rollers 36 which mount the carriage panel 34 onto the extension truss member 17. Extending rearwardly from the carriage panel 34 is a boom member 38 which is supported by cables 39 to the carriage panel 34. At the distal end of the boom member is a crossbeam 40 which is connected by a cable to a hand winch 43 mounted on the carriage panel 34. The crossbeam 40 is secured to an elongated boom pipe 42 which includes spray nozzles 44 positioned thereon and extending downwardly therefrom. Preferably, the spray nozzles 44 are equally spaced along the length of the boom pipe 38. The hand winch 43 raises and lowers the boom extension member 38 relative to the surface of the poured concrete. This raising and lowering of the boom extension member fixes the height between the boom pipe 42 and spray nozzles 44 and the concrete surface. Positioned about the elongated shaped boom pipe and spray nozzles is a hood shield member 41 which reduces the effect of the wind during the application of the curing compound onto the finished concrete.

Figure 9:
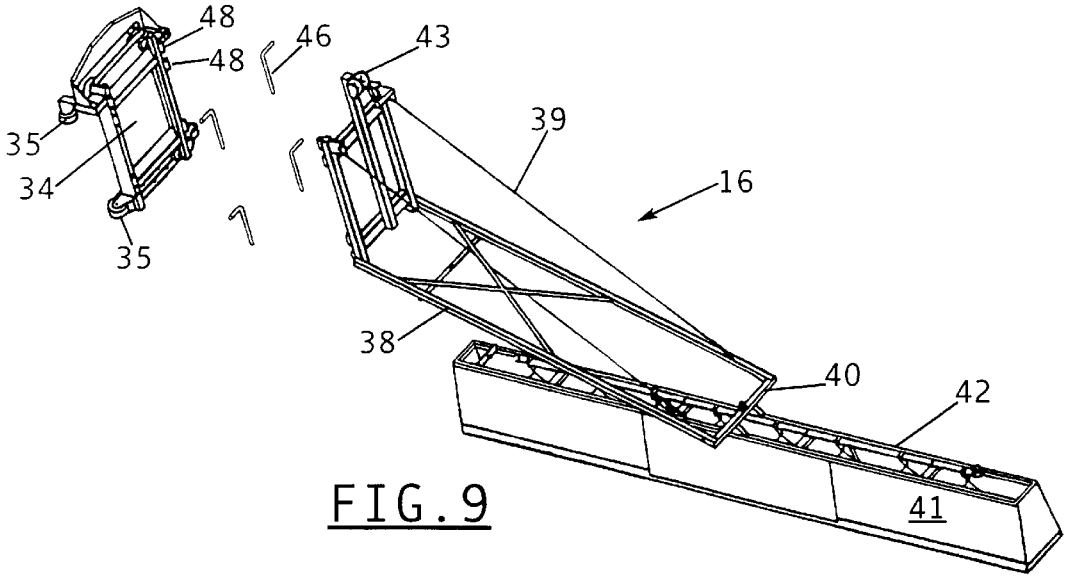
FIG. 9 is an exploded perspective view of the sprayboom carriage unit and the mounting assembly for securing the carriage unit to the extension truss member in accordance with the present invention.
Figure 10:
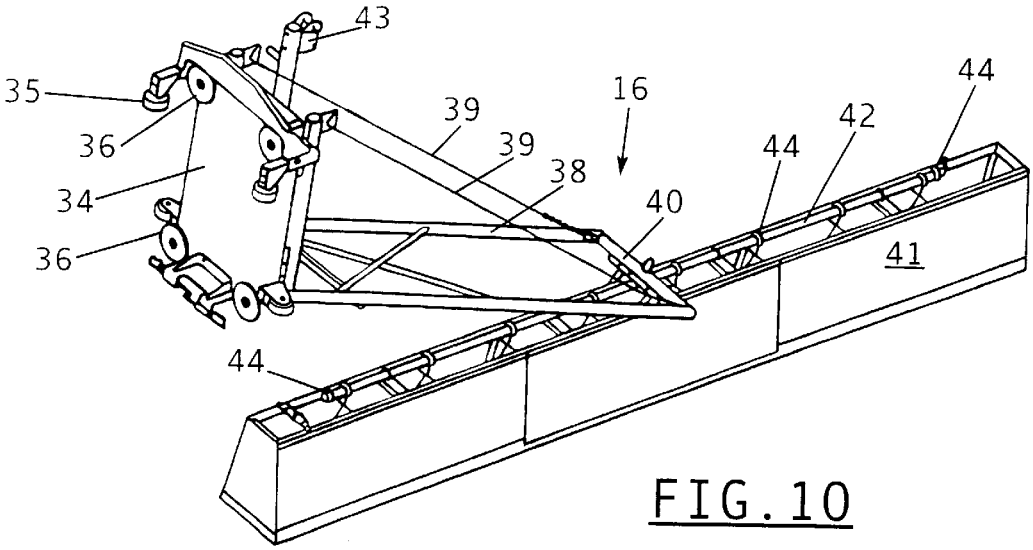
FIG. 10 is a rear perspective view of the sprayboom carriage unit and the mounting assembly for securing the carriage unit to the extension truss member in accordance with the present invention.

As shown in FIGS. 4–7, mounted to the truss member 17 is a drive motor 30 that is operatively connected through a drive sprocket 31, an idler sprocket 33 and a drive chain 32 secured to the carriage panel 34, as will hereinafter be described. Actuation of the hydraulic motor 30 turns the drive chain 32 to cause the carriage panel and the suspended sprayboom carriage member 16 to move back and forth across the length of the extension truss member 17. The boom member 38 and associated boom pipe and hood shield are removable from the carriage panel by the removal of pins 46 from the aligned bracket members 48 on the carriage panel 34 and boom member 38, as shown in FIG. 9. This permits the curing machine to be reduced in width to permit transport of the curing machine between job sites.

Figure 11:
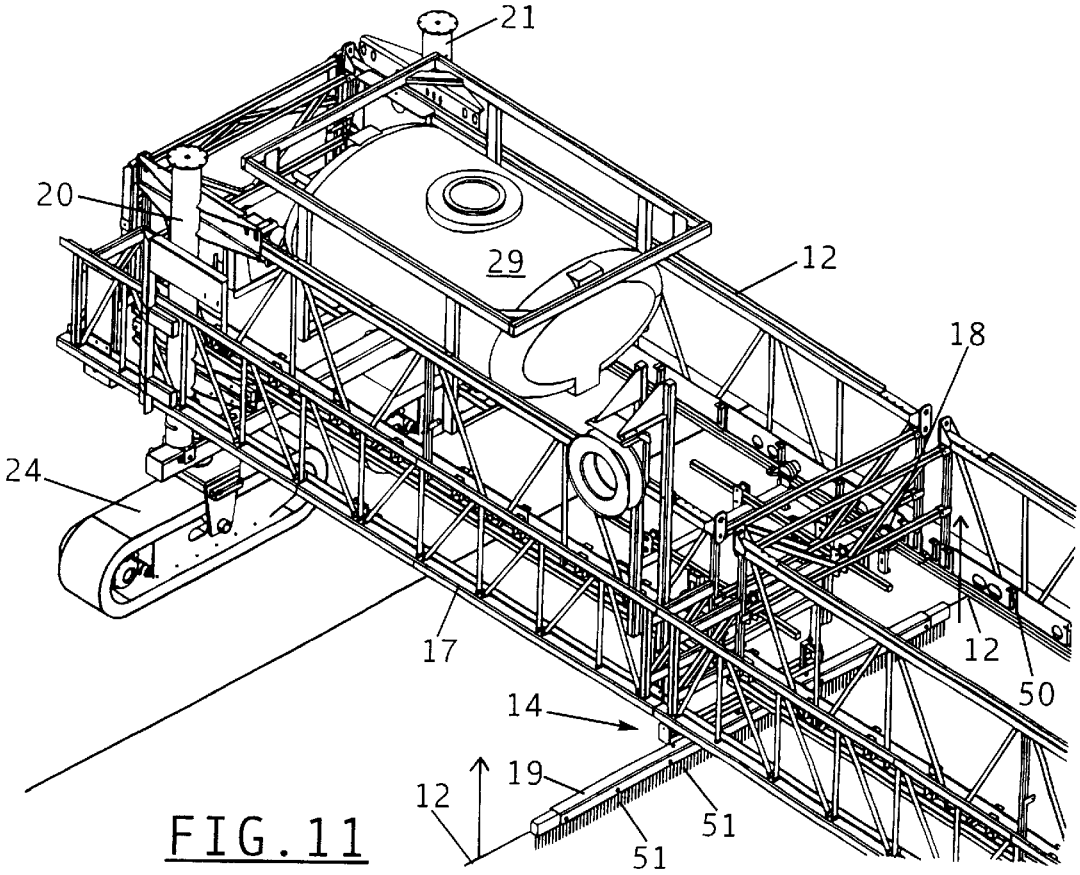
FIG. 11 is a partial exploded perspective view of the concrete curing and texturing machine in accordance with the embodiment of the present invention shown in FIG. 3.

In FIG. 11, the elongated trusswork or frame 12 supports a reservoir 29 which contains the curing compound that is uniformly sprayed onto the surface of the finished or grooved concrete. The elongated trusswork or frame 12, preferably, also supports the texturing or grooving unit 14 having a plurality of tines 51 thereunder and permits the back and forth travel of the texturing or grooving unit 14 across the surface of the concrete.

Figure 12:
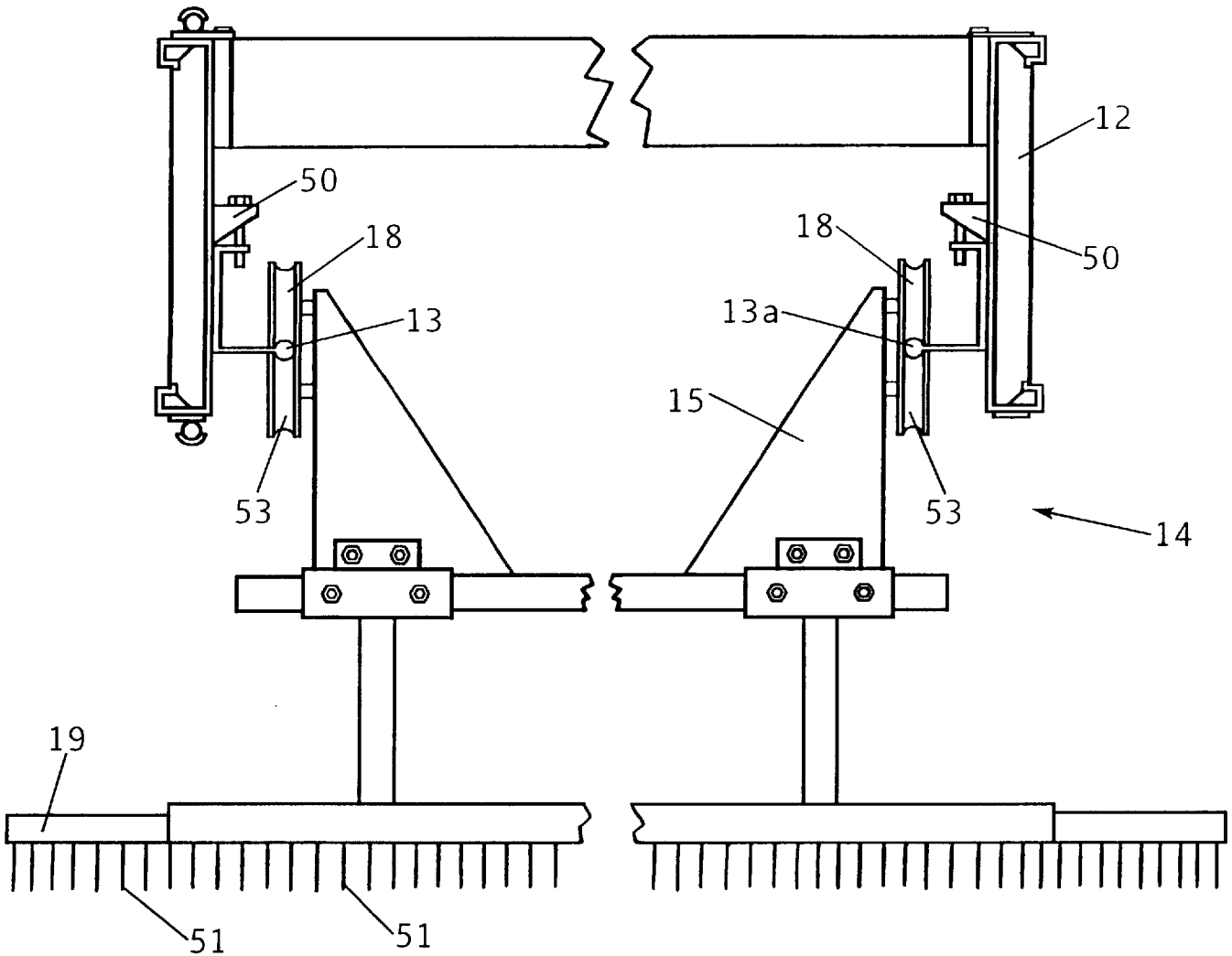
FIG. 12 is a view taken along lines 12—12 in FIG. 11 showing a texturing and grooving unit in accordance with one embodiment of the present invention.

The texturing or grooving unit 14 includes a carriage member 15 and two pairs of outwardly projecting spaced rollers 18 mounted on respective upper ends in a position that the rollers are structurally arranged to be supported and ride along the inner edges of elongated tracks 13 and 13*a* on opposite sides of the trusswork frame member 12. The tracks support the texturing or grooving unit 14 for movement longitudinally of the trusswork frame 12. The tracks 13 and 13*a* support the texturing or grooving unit 14 from the sides of the trusswork frame 13 by vertically adjustable hangars 50 so that the level of tracks 13 and 13*a* at various points along the elongated trusswork frame 12 may be adjusted, as desired. As shown in FIG. 12, a pair of hold down rollers 53 are mounted on each of the ends of the carriage 15 below the pair of upper rollers 51 and 52. The rollers are positioned such that when the carriage 15 of the grooving unit 14 is supported on the tracks 13 and 13*a*, the rollers are in abutting engagement with lower surfaces of the tracks to hold the rollers 53 downwardly against the tracks 13 and 13*a*.

As shown in FIG. 12, the texturing carriage unit 15 suspends and holds a grooving or texturing member 19 to be engageable with the surface of the concrete during each back and forth movement of the texturing unit across the surface of the poured concrete. The timed texturing member or comb 19 may be of any length ranging from about 3 to 12 feet in length.

Figure 14:
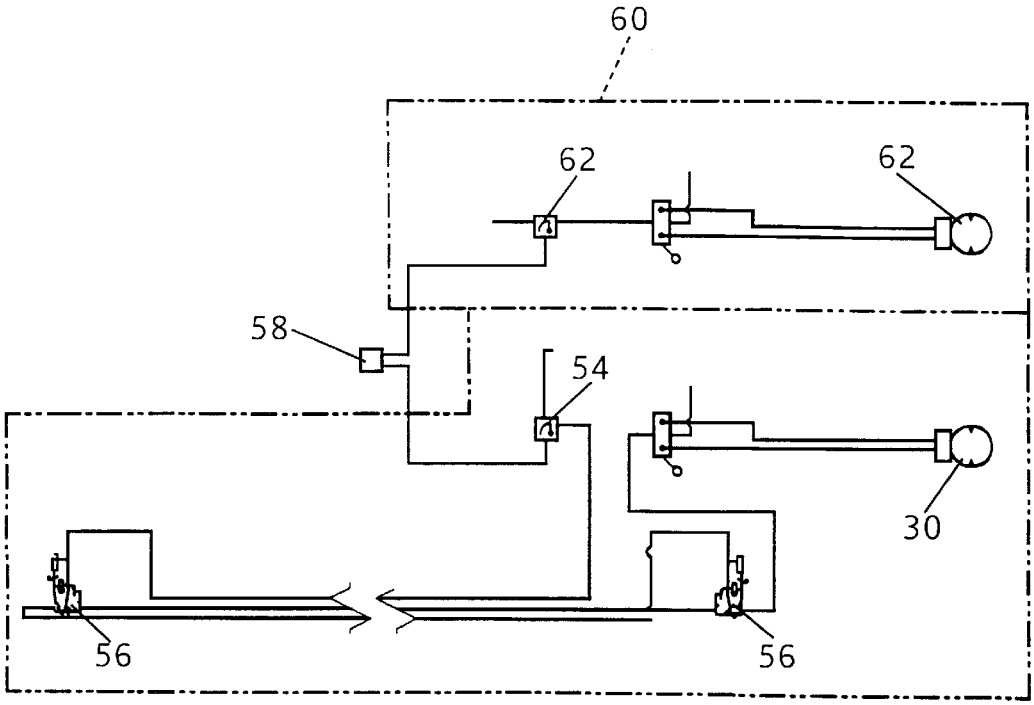
FIG. 14 is a schematic view illustrating the diagram of the hydraulic circuit of the concrete curing and texturing machine in accordance with the present invention shown in FIG. 1.

FIG. 14 illustrates the hydraulic circuitry of the concrete curing machine in accordance with the present invention. The hydraulic motor 30 operates to move the sprayboom carriage back and forth across the body of the poured concrete. The hydraulic motor 30 provides pressurized hydraulic oil through carriage speed control valve 54 which meters the flow rate for the hydraulic oil communicating with the sprayboom carriage 16. Upon each pass of the sprayboom carriage across the poured concrete, the sprayboom carriage engages a stop or valve members 56 which reverses the operation of the respective carriage to cause the carriage to travel back and forth upon engagement of the carriage stop valves on each end of the curing machine. By regulating the hydraulic drive motor 30 through the carriage speed control 54 to the sprayboom carriage 16, the rate of travel of the sprayboom carriage across the surface of the concrete is controlled which controls and regulates the amount of curing compound applied to the concrete surface. After each pass of the sprayboom carriage across the concrete surface, the curing compound flowing through the boom pipe is stopped until the sprayboom carriage starts to travel across the concrete surface. A flow divider member 58 is associated with the speed control valve 54 to provide a control for the texturing unit 14, as shown by the dotted line 60 in FIG. 14. This controls the motor 62 which powers the texturing unit 14 through speed control valve 62. This permits the precise control of the operation and speed of the texturing unit 14 relative to the speed and operation of the sprayboom unit 16.

Figure 13:
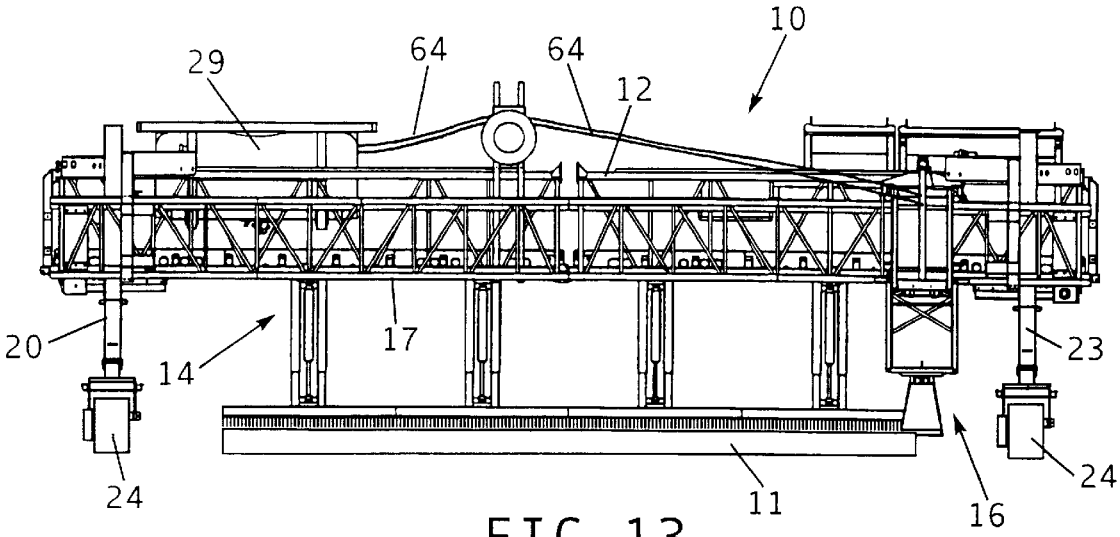
FIG. 13 is a rear view of the concrete curing and texturing machine in accordance with a further embodiment of the present invention.

In usage, generally the texturing unit and spraying unit operate in tandem on the surface of the finished concrete. When each pass of the units is completed, the curing machine is moved forwardly a distance equal to the length of the texturing comb. A hose 64 (FIG. 13) is provided to connect the curing compound reservoir 29 with the boom pipe and spray nozzles such that during the back and forth movement of the sprayboom carriage 16 over the surface of the concrete, a predetermined amount of curing compound may be deposited onto the exposed concrete surface. The curing compound is applied to the concrete surface at a rate between approximately 50 square feet to 200 square feet per gallon of curing compound.

Figure 3:
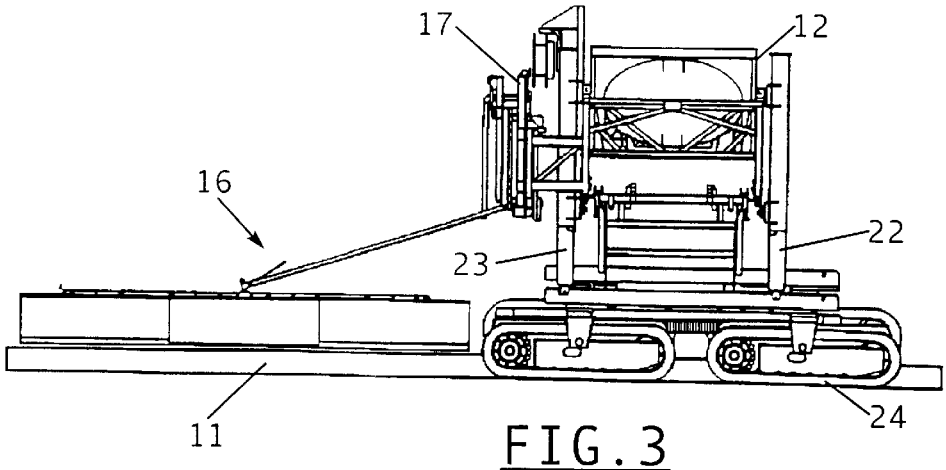
FIG. 3 is an end view of the concrete curing and texturing machine in accordance with the embodiment of the present invention shown in FIG. 1.
Figure 3A:
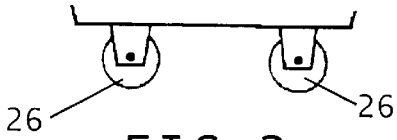
FIGS. 3A and 3B schematically illustrate rubber wheel and two-track power drive units in accordance with the present invention.
Figure 3B:
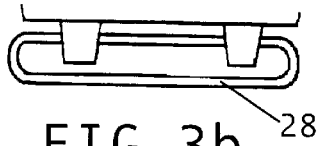
Figure 4:
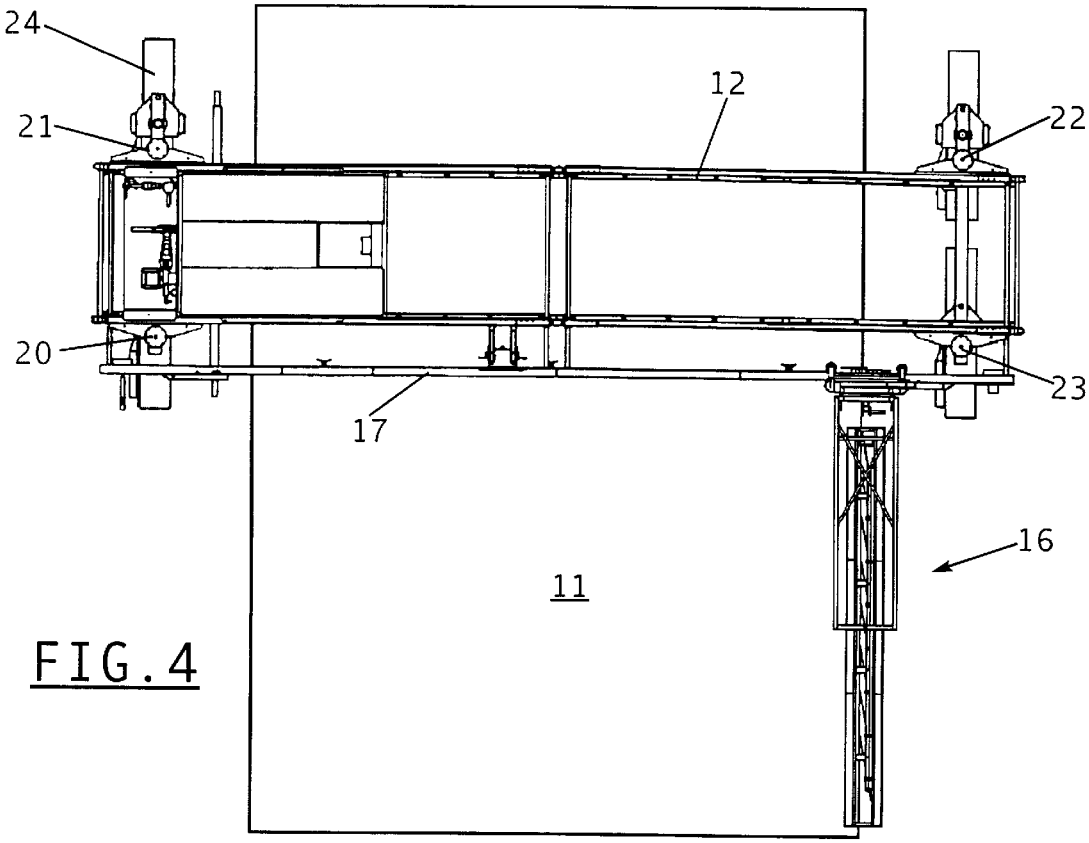
FIG. 4 is a top view of the concrete curing and texturing machine in accordance with the embodiment of the present invention shown in FIG. 3.
Figure 5:
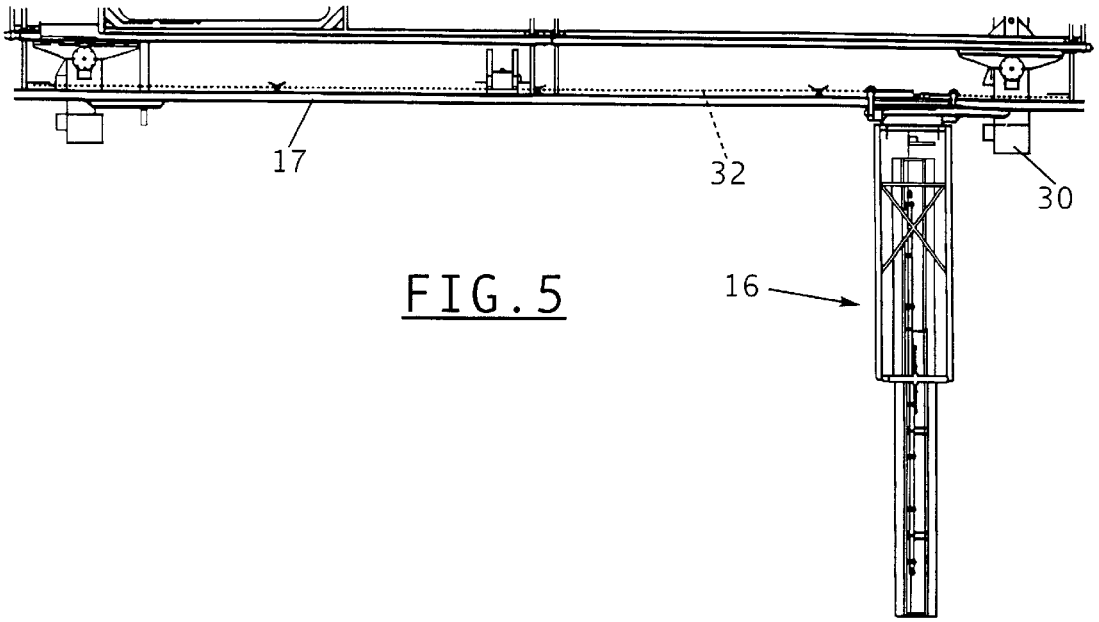
FIG. 5 is a partial top plan view showing the mounting of the sprayboom carriage assembly to the extended truss member in accordance with one embodiment of the present invention.
Figure 6:
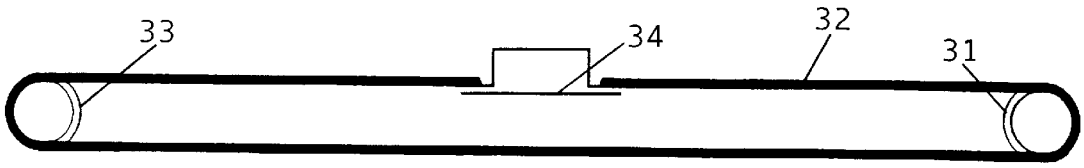
FIG. 6 is a schematic view illustrating the drive chain mechanism for the longitudinal movement back and forth of the sprayboom carriage assembly in accordance with the present invention.
Figure 7:
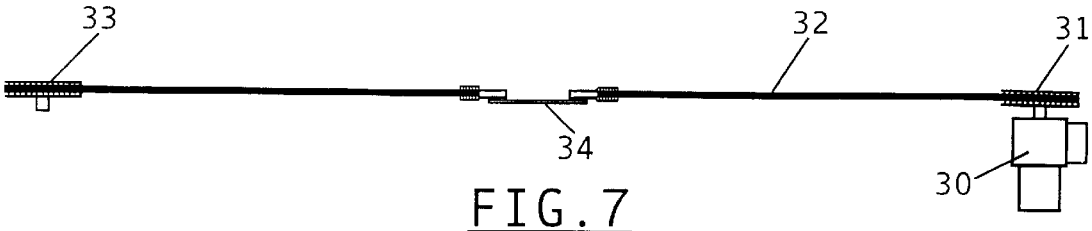
FIG. 7 is a top plan view of the drive chain mechanism for the sprayboom carriage assembly in accordance with the present invention.
Figure 8:
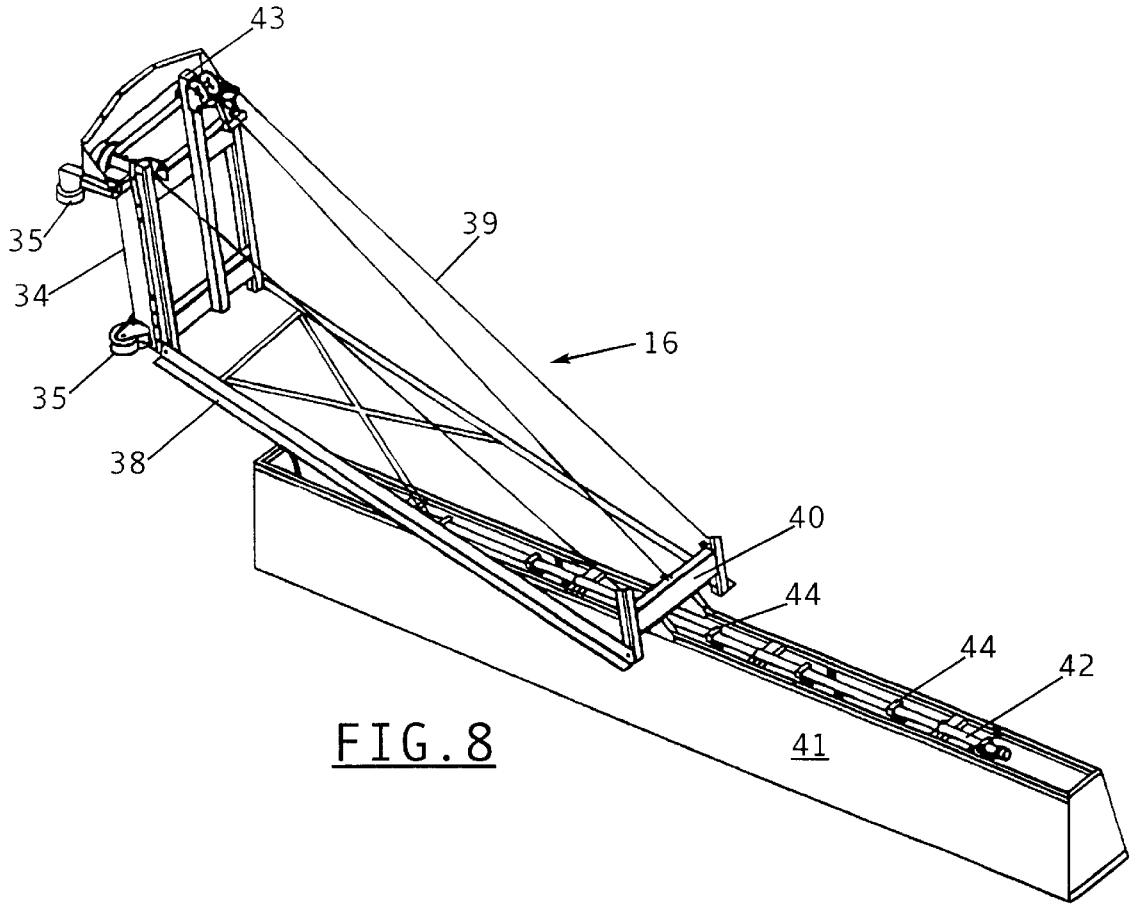
FIG. 8 is a perspective view of the sprayboom carriage unit and extended sprayboom and nozzle assembly for uniformly depositing the curing fluid onto the surface of the finished concrete.

The scope of the present invention provides that a texturing or grooving unit 14 having a texturing comb 51 may be suspended longitudinally from the elongated trusswork or frame 12 of the curing machine to provide a machine that provides vertical grooves in the concrete, as shown in FIG. 3.

It has been found that in accordance with the present invention the lateral back and forth movement of the sprayboom carriage relative to the surface of the concrete and the application of the curing compound thereon results in the retention of satisfactory moisture content and temperature conditions in the cured concrete, which results in optimum concrete properties of the final cured concrete slab.

Additionally, it has been found that in accordance with the present invention, when the present invention is utilized in conjunction with a rake or texturing implement that travels back and forth across the body of the poured concrete to groove the concrete, that the immediate application thereto of the curing compounds in accordance with the present claimed structure maximizes the concrete quality and results in a durable pavement surface.

We claim:

1. A concrete curing machine including an elongated truss frame having first and second ends, with the elongated truss frame supporting a reservoir of curing fluid and having a drive member positioned at the first and second ends of the truss frame for moving the truss frame longitudinally along a roadway being surfaced with concrete, with said elongated truss frame including an elongated truss member mounted rearwardly thereof, with the concrete curing machine comprising a sprayboom carriage member structurally arranged and mounted to the elongated extended truss member and adapted to longitudinally move back and forth along the elongated extended truss member, with said sprayboom carriage member supporting a sprayboom having a plurality of nozzles thereon operatively connected to the liquid reservoir to deposit a predetermined amount of the curing liquid onto the surface of the finished concrete.

2. The concrete curing machine in accordance with claim 1, wherein the drive member for moving the truss frame longitudinally along the roadway includes rubber tire drive members mounted substantially to the first and second ends of the elongated truss frame.

3. The concrete curing machine in accordance with claim 1, wherein the drive member for moving the truss frame longitudinally along a roadway includes a four-track drive member substantially mounted to the first and second ends of the truss frame assembly.

4. The concrete curing machine in accordance with claim 1, wherein the drive member for moving the main frame longitudinally along a roadway includes a pair of tracks mounted substantially to the first and second ends of the elongated truss frame.

5. The concrete curing machine in accordance with claim 1, wherein said sprayboom carriage member includes a carriage panel having carriage rollers engageable with said elongated extended truss member to movably mount said carriage member to said elongated extended truss member.

6. The concrete curing machine in accordance with claim 5, wherein said carriage member is attached to motor means to power said carriage member back and forth along said elongated extended truss member.

7. The concrete curing machine in accordance with claim 1, wherein said sprayboom includes a shield member positioned therearound to reduce the effect of the wind during the application of the sprayed curing liquid onto the surface of the concrete.

8. The concrete curing machine in accordance with claim 1, wherein the concrete curing machine includes a texturing carriage unit mounted to the elongated truss frame and structurally arranged and adapted to longitudinally move back and forth along the elongated truss frame.

9. The concrete curing machine in accordance with claim 8, wherein said texturing carriage unit includes an elongated comb member structurally arranged and adapted to longitudinally move back and forth along the elongated truss frame to engage the surface of the concrete to groove the same.

10. The concrete curing machine in accordance with claim 1, wherein said sprayboom carriage member includes a height adjusting member to predeterminely control the distance between said sprayboom and the surface of the finished concrete.

11. A concrete curing and texturing machine, including in combination;

an elongated truss frame having first and second ends, with said truss frame supporting a reservoir of curing fluid and having a drive member positioned at the first and second ends of said truss frame for moving the truss frame longitudinally along a roadway or the like being surfaced of finished concrete;

a texturing carriage unit mounted to said elongated truss frame and structurally arranged and adapted to engage the concrete to provide longitudinal grooves in the concrete;

an elongated extended truss member mounted rearwardly of said elongated truss frame; and a sprayboom carriage member structurally arranged and mounted to said elongated extended truss member and adapted to longitudinally move back and forth along said elongated truss member, with said sprayboom carriage member supporting a sprayboom having a plurality of nozzles thereon and being operably connected to the liquid reservoir to deposit a predetermined amount of the curing liquid onto the surface of the concrete.

12. A concrete curing and texturing machine, including in combination:

an elongated truss frame having first and second ends, with said truss frame supporting a reservoir of curing fluid and having a drive member positioned at the first and second ends of said truss frame for moving the truss frame longitudinally along a roadway being surfaced of finished concrete;

a texturing carriage unit mounted to said elongated truss frame and structurally arranged and adapted to longitudinally move back and forth along said elongated truss frame;

an elongated extended truss member mounted rearwardly of said elongated truss frame; and a sprayboom carriage member structurally arranged and mounted to said elongated extended truss member and adapted to longitudinally move back and forth along said elongated truss member, with said sprayboom carriage member supporting a sprayboom having a plurality of nozzles thereon and being operably connected to the liquid reservoir to deposit a predetermined amount of the curing liquid onto the surface of the concrete.

13. The concrete curing machine in accordance with claim 12, wherein said drive member for moving the truss frame longitudinally along the roadway includes rubber tire drive members mounted substantially to said first and second ends of the elongated truss frame.

14. The concrete curing machine in accordance with claim 12, wherein said drive member for moving the truss frame longitudinally along a roadway includes a four-track drive member substantially mounted to said first and second ends of the truss frame assembly.

15. The concrete curing machine in accordance with claim 12, wherein said drive member for moving the main frame longitudinally along a roadway includes a pair of tracks mounted substantially to said first and second ends of the elongated truss frame.

16. The concrete curing machine in accordance with claim 12, wherein said sprayboom carriage member includes a height adjusting member to predeterminely control the distance between said sprayboom and the surface of the finished concrete.

17. The concrete curing machine in accordance with claim 12, wherein said sprayboom includes a shield member positioned therearound to reduce the effect of the wind during the application of the sprayed curing liquid onto the surface of the concrete.

18. The concrete curing machine in accordance with claim 12, wherein said texturing carriage unit includes an elongated comb member structurally arranged and adapted to longitudinally move back and forth along the elongated truss frame to engage the surface of the concrete to groove the same.

19. The concrete curing machine in accordance with claim 12, wherein said sprayboom carriage member includes a carriage panel having carriage rollers engageable with said elongated extended truss member to mount said carriage member to said elongated extended truss member.

20. The concrete curing machine in accordance with claim 19, wherein said carriage member is attached to motor means to power said carriage member back and forth along said elongated extended truss member.

21. The concrete curing and texturing machine in accordance with claim 20, further including control means for predeterminely controlling the rate of travel of each of said texturing carriage unit and said sprayboom carriage member with respect to one another back and forth across the surface of the concrete.

* * * * *